US010535946B2

(12) United States Patent
Ho et al.

(10) Patent No.: US 10,535,946 B2
(45) Date of Patent: Jan. 14, 2020

(54) ELECTRICAL CONNECTOR

(71) Applicant: LOTES CO., LTD, Keelung (TW)

(72) Inventors: Tung Ming Ho, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/391,658

(22) Filed: Apr. 23, 2019

(65) Prior Publication Data

US 2019/0326697 A1 Oct. 24, 2019

(30) Foreign Application Priority Data

Apr. 24, 2018 (CN) ..... 2018 1 0371554

(51) Int. Cl.
*H01R 13/24* (2006.01)
*H01R 12/70* (2011.01)

(52) U.S. Cl.
CPC ..... *H01R 13/2457* (2013.01); *H01R 12/707* (2013.01); *H01R 12/7076* (2013.01)

(58) Field of Classification Search
CPC ..... H01R 12/55; H01R 13/2492; H01R 13/2457; H01R 12/57; H01R 12/707
See application file for complete search history.

(56) References Cited

U.S. PATENT DOCUMENTS 3,407,379 A * 10/1968 Nakazawa ..... H01R 12/82 439/637
4,288,139 A * 9/1981 Cobaugh ..... H01R 12/89 439/267
4,892,492 A * 1/1990 Mueller ..... H01R 4/4818 439/78
6,688,893 B1 * 2/2004 Huang ..... H01R 12/57 439/66
7,156,706 B2 * 1/2007 Brown ..... H01R 13/2492 439/66
7,467,949 B2 * 12/2008 Liao ..... H01R 13/2435 439/66

(Continued)

FOREIGN PATENT DOCUMENTS

CN 201204289 Y 3/2009
CN 201266710 Y 7/2009

(Continued)

*Primary Examiner* — Briggitte R. Hammond
(74) *Attorney, Agent, or Firm* — Locke Lord LLP; Tim Tingkang Xia, Esq.

(57) ABSTRACT

An electrical connector is provided for electrically connecting a circuit board and an electronic component having at least one conductive member. The electrical connector includes: an insulating body; at least one first terminal having a first base accommodated in the insulating body, and a first elastic arm extending upward from the first base and exposed from the insulating body; and at least one second terminal having a second base fixed to the first base, and a second elastic arm extending upward from the second base and exposed from the insulating body. The first elastic arm has a first contact portion and a first notch. The second elastic arm has a second contact portion. The first and second contact portions both extend forward, and the second contact portion is accommodated in the first notch such that the first and second contact portions are in contact with a same conductive member.

20 Claims, 9 Drawing Sheets

(56) References Cited

U.S. PATENT DOCUMENTS

| | | | | |
|---|---|---|---|---|
| 7,559,811 | B1 * | 7/2009 | Polnyi | H01R 4/4809 439/591 |
| 7,563,105 | B2 * | 7/2009 | Liu | H01R 13/2492 439/66 |
| 7,857,632 | B2 * | 12/2010 | Liu | H01R 13/2492 439/66 |
| 8,235,734 | B2 * | 8/2012 | Ju | H01R 12/57 439/83 |
| 8,323,038 | B2 * | 12/2012 | Jin | H01R 12/714 439/66 |
| 8,708,716 | B1 * | 4/2014 | Ho | H01R 12/714 439/83 |
| 8,888,525 | B2 * | 11/2014 | Yeh | H01R 13/17 439/539 |
| 10,199,756 | B2 * | 2/2019 | Ju | H01R 13/2435 |
| 10,230,177 | B2 * | 3/2019 | Ju | H01R 13/2442 |
| 10,326,225 | B2 * | 6/2019 | Ju | H01R 12/7076 |
| 2010/0184334 | A1 * | 7/2010 | Ma | H01R 13/2442 439/626 |

FOREIGN PATENT DOCUMENTS

| | | | |
|---|---|---|---|
| CN | 202585853 | U | 12/2012 |
| CN | 107240798 | A | 10/2017 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810371554.0 filed in China on Apr. 24, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector having dual conductive channels and miniaturized terminals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has an insulating body, and a plurality of terminals accommodated in the insulating body. Each of the terminals has a first conductive terminal and a second conductive terminal. The first conductive terminal and the second conductive terminal are of a separate design, and the first conductive terminal can be assembled and positioned to the second conductive terminal. The first conductive terminal includes a base and a first elastic portion bending and extending upward and forward from the base, and a first contact portion electrically connected to a chip module is formed at the tail end of the first elastic portion. The second conductive terminal includes a retaining portion and a second elastic portion bending and extending upward and forward from one end of the retaining portion, and a second contact portion electrically connected to the chip module is formed at the second elastic portion. The base and the retaining portion are attached and fixed in a front-rear direction, and the first elastic portion and the second elastic portion are spaced apart from each other to ensure that the first elastic portion and the second elastic portion do not touch each other when being elastically deformed by the pressure of the chip module, thereby satisfying the demand of multiple contact points on the electrical connector terminals.

However, the first elastic portion bends and extends upward and forward from the base, and the second elastic portion bends and extends upward and forward from the retaining portion. Therefore, a distance between the first elastic portion and the second elastic portion in the front-rear direction gradually increases upward from the bottom, such that the first contact portion and the second contact portion have a certain interval in the front-rear direction. When more terminals are required to be arranged, and the first and second contact portions of each terminal are required to have a certain interval, the terminals cannot be densely arranged in a limited-sized insulating body, which is disadvantageous for high-frequency performance of the electrical connector.

Therefore, a heretofore unaddressed need to design a new electrical connector exists in the art to address the aforementioned deficiencies and inadequacies.

SUMMARY

An objective of the present invention is to provide an electrical connector in which multiple terminals can be densely arranged due to miniaturization of the terminals.

To achieve the foregoing objective, the present invention adopts the following technical solutions: an electrical connector configured to electrically connect a circuit board and an electronic component, the electronic component having at least one conductive member configured to be electrically connected to the electrical connector, and the electrical connector including: an insulating body; at least one first terminal having a first base accommodated in the insulating body, and a first elastic arm extending upward from the first base and exposed from the insulating body, wherein the first elastic arm has a first contact portion and a first notch; and at least one second terminal having a second base fixed to the first base, and a second elastic arm extending upward from the second base and exposed from the insulating body, wherein the second elastic arm has a second contact portion; wherein the first contact portion and the second contact portion both extend forward, and the second contact portion is accommodated in the first notch such that the first contact portion and the second contact portion are in contact with a same one of the at least one conductive member.

In certain embodiments, the first contact portion and the second contact portion are provided face-to-face in a left-right direction.

In certain embodiments, the first contact portion has a first side wall facing the second contact portion, the second contact portion has a second side wall facing the first contact portion, and the first side wall and the second side wall are provided to be attached in the left-right direction.

In certain embodiments, a tail end of the first contact portion is in contact with a tail end of the second contact portion.

In certain embodiments, the first elastic arm has a first portion and a second portion, the first portion extends upward and backward from the first base, the second portion extends reversely and upward from the first portion, the first contact portion extends upward and forward from the second portion, and a width of the first contact portion is less than a width of the second portion to form the first notch.

In certain embodiments, the second elastic arm has a third portion and a fourth portion, the third portion extends upward and backward from the second base, the fourth portion extends reversely and upward from the third portion, the second contact portion extends upward and forward from the fourth portion, and a width of the second contact portion is less than a width of the fourth portion to form a second notch.

In certain embodiments, the first contact portion is located at the second notch, and the second contact portion is located at the first notch.

In certain embodiments, the first portion and the second portion form an accommodating space, the third portion and the fourth portion are both accommodated in the accommodating space, the first portion and the third portion are provided face-to-face to each other, and the second portion and the fourth portion are provided face-to-face to each other.

In certain embodiments, the second portion has a third side wall connected to the first contact portion and facing the first notch, and the third side wall downward stops the second contact portion.

In certain embodiments, the fourth portion has a fourth side wall connected to the second contact portion and facing the second notch, and the fourth side wall upward stops the first contact portion.

In certain embodiments, a sum of a width of the first contact portion and a width of the second contact portion is less than or equal to a width of the first elastic arm.

In certain embodiments, the electrical connector further includes: a first conductive portion configured to be electrically connected to the circuit board, wherein the first conductive portion is electrically connected to a lower end of the first base; a second conductive portion configured to be electrically connected to the circuit board, wherein the second conductive portion is electrically connected to a lower end of the second base and located above the first conductive portion; and a solder material, wherein the first conductive portion and the second conductive portion are attached to the same solder material, and the solder material solders and fixes the first conductive portion and the second conductive portion to the circuit board.

The present invention further adopts another technical solution: an electrical connector configured to electrically connect a circuit board and an electronic component, the electronic component having at least one conductive member configured to be electrically connected to the electrical connector, and the electrical connector including: an insulating body; at least one first terminal accommodated in the insulating body, wherein an upper end of the first terminal has a first contact portion and a first notch, and a lower end of the first terminal has a first conductive portion; at least one second terminal, wherein an upper end of the second terminal has a second contact portion, and a lower end of the second terminal has a second conductive portion; and a solder material configured to electrically connect the first conductive portion and the second conductive portion to the circuit board, wherein the first conductive portion and the second conductive portion are attached to the same solder material; wherein the first contact portion and the second contact portion both extend forward, and the second contact portion is accommodated in the first notch such that the first contact portion and the second contact portion are in contact with a same one of the at least one conductive member.

In certain embodiments, the first contact portion and the second contact portion are provided face-to-face in a left-right direction.

In certain embodiments, the first contact portion has a first side wall facing the second contact portion, the second contact portion has a second side wall facing the first contact portion, and the first side wall and the second side wall are provided to be attached in the left-right direction.

In certain embodiments, a tail end of the first contact portion is in contact with a tail end of the second contact portion.

In certain embodiments, the first terminal further has a first base connected to the first conductive portion, a first portion extends upward and backward from an upper end of the first base, a second portion extends reversely and upward from the first portion, the first contact portion extends upward from the second portion, and the first portion and the second portion form an accommodating space configured to accommodate a portion of the second terminal.

In certain embodiments, the second terminal further has a second base connected to the second conductive portion, a third portion extends upward from the upper end of the second base, a fourth portion extends reversely and upward from the third portion, the second contact portion extends upward from the fourth portion, and the third portion and the fourth portion are accommodated in the accommodating space.

In certain embodiments, the first terminal further has a first base, a lower end of the first base is connected to the first conductive portion, the second terminal further has a second base, a lower end of the second base is connected to the second conductive portion, the first base and the second base are spaced apart, the first conductive portion and the second conductive portion are spaced apart, and the solder material is located between the first conductive portion and the second conductive portion.

In certain embodiments, the first terminal further has a first base, two first conductive portions respectively extend from a left side and a right side of the first base, the second terminal further has a second base attached and fixed to the first base, the second conductive portion extends forward from a lower end of the second base, the two first conductive portions are respectively located at a left side and a right side of the solder material, and the second conductive portion is located above the solder material.

Compared with the related art, the first elastic arm has a first contact portion and a first notch. At least one second terminal has a second base, and a second elastic arm extending upward from the second base and exposed from the insulating body. The second elastic arm has a second contact portion. The second contact portion is accommodated in the first notch downward from top and abuts the first contact portion in the left-right direction, such that the sizes of the first elastic arm and the second elastic arm in a front-rear direction is reduced, thereby allowing more terminals to be provided in a limited space above the insulating body.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
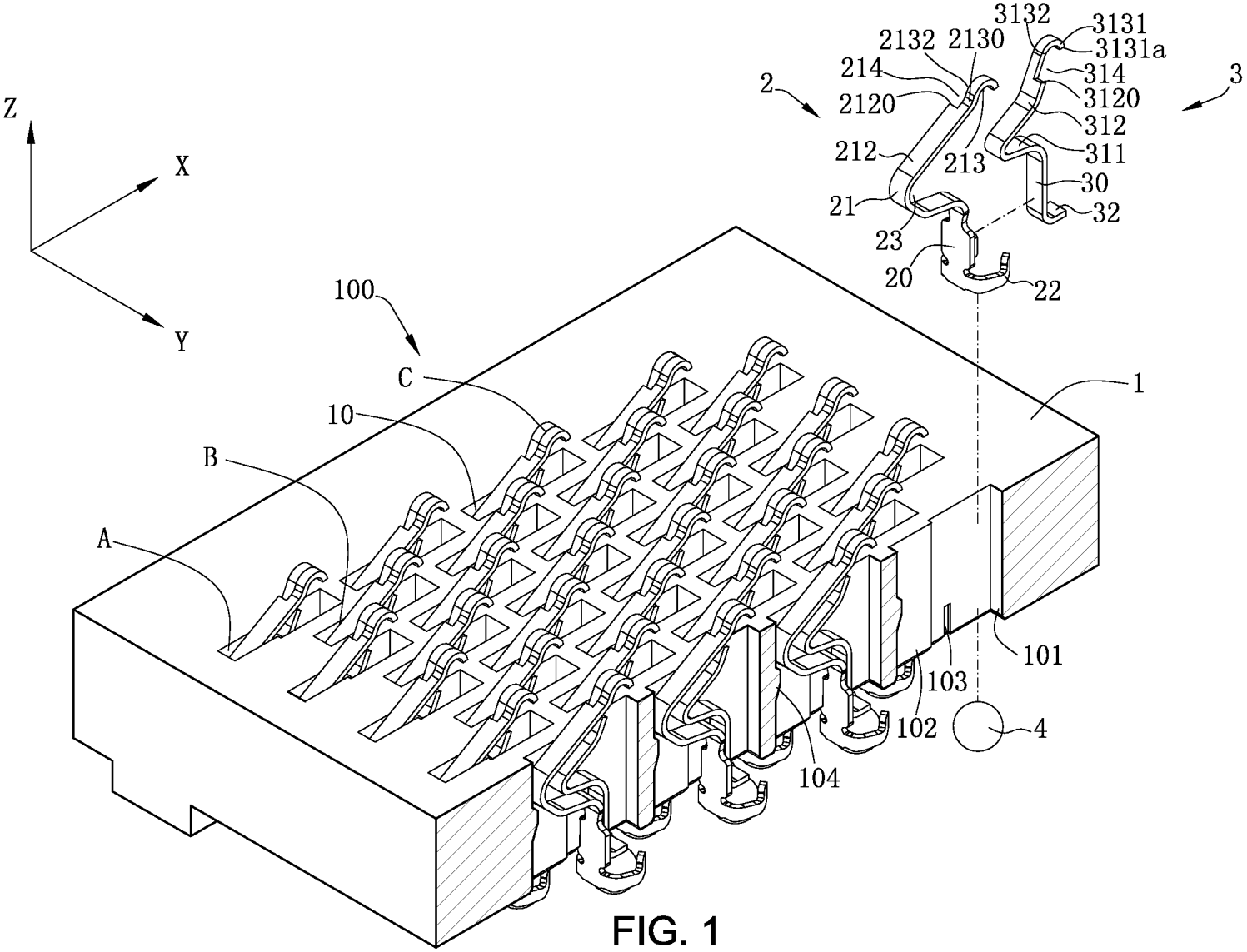
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 2:
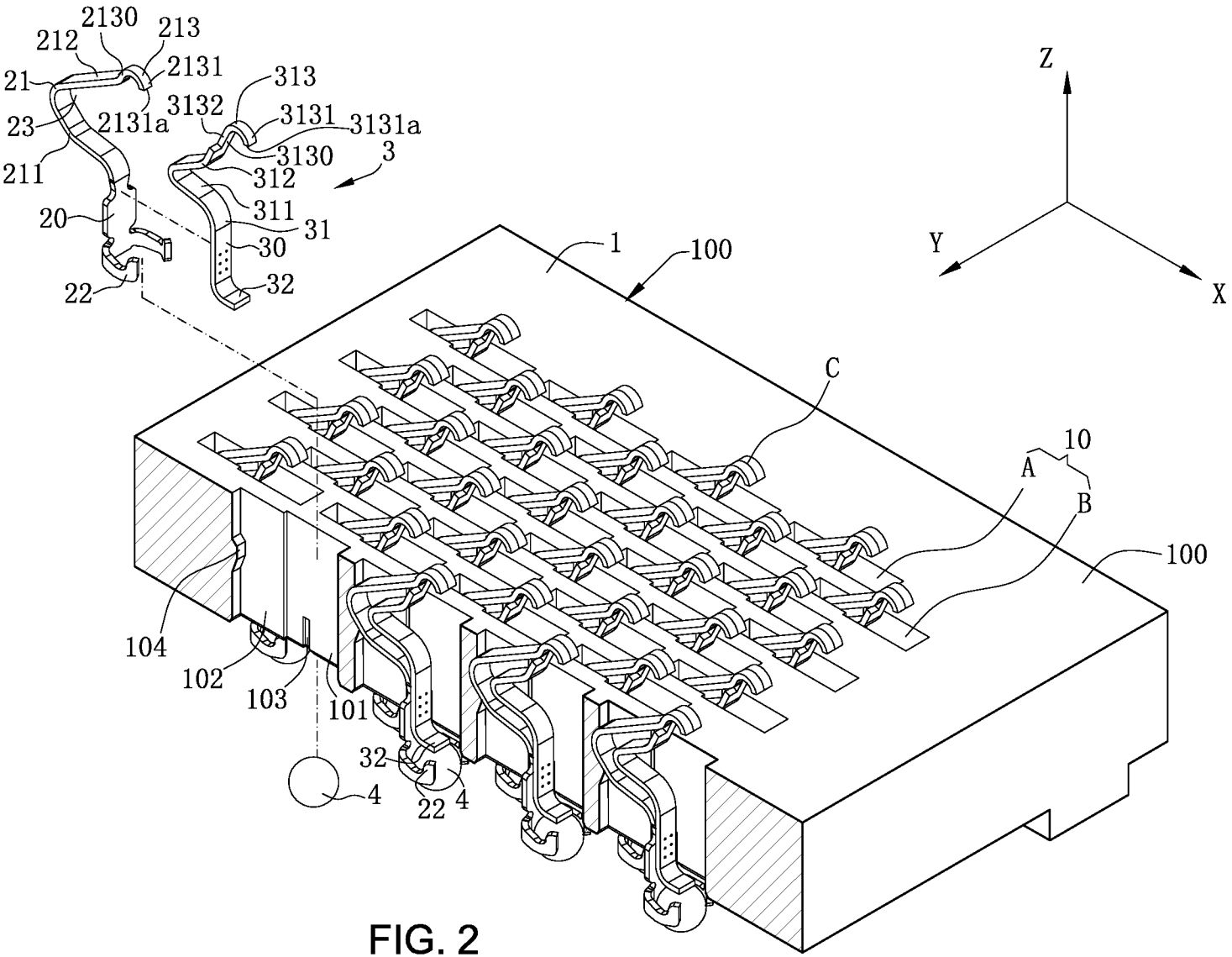
FIG. 2 is a perspective exploded view of the electrical connector in FIG. 1 from another viewing angle.
Figure 3:
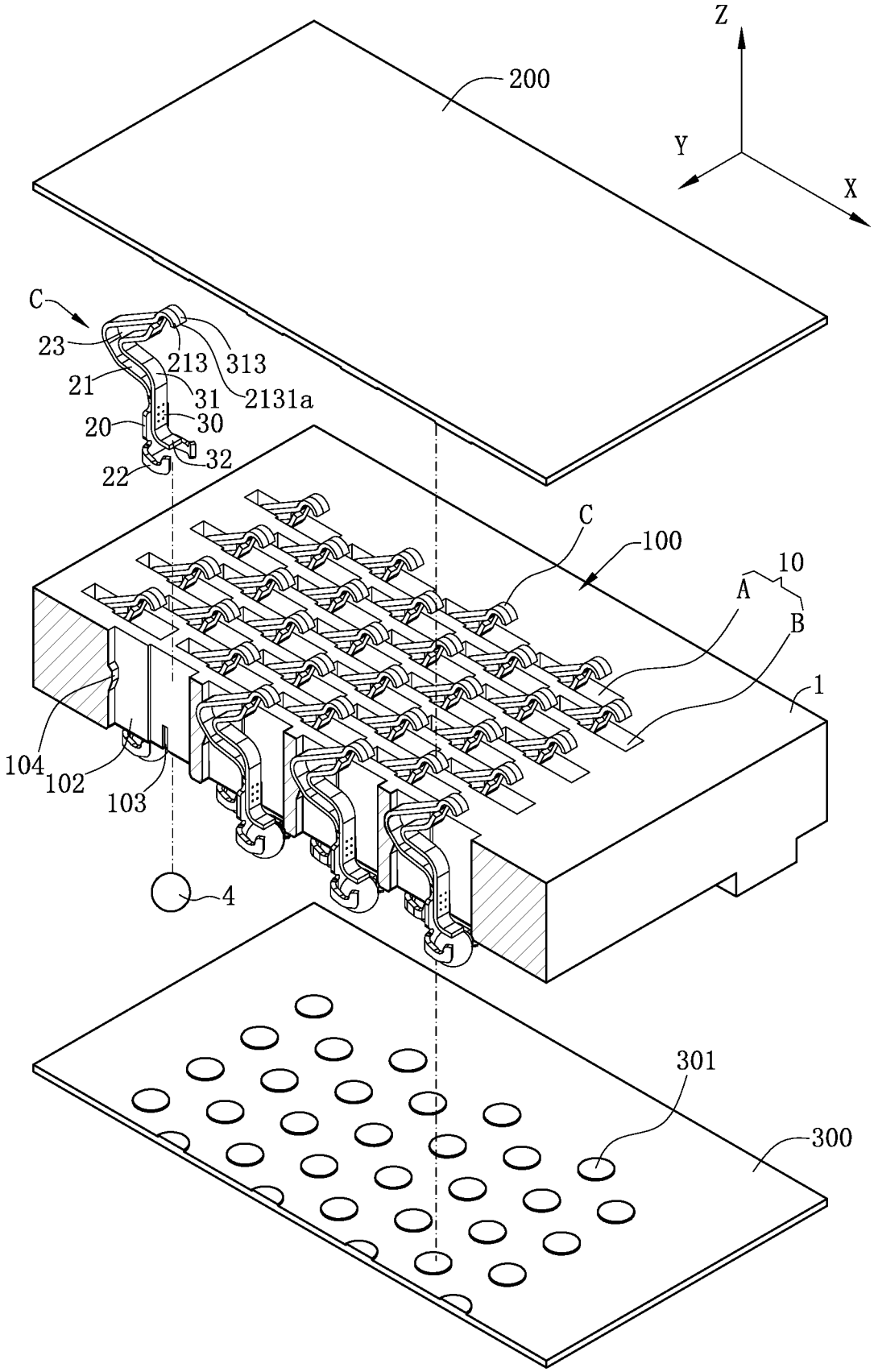
FIG. 3 is a perspective exploded view of the electrical connector in FIG. 1, a chip module and a circuit board.

Referring to FIG. 1, FIG. 2 and FIG. 3, an electrical connector 100 according to a first embodiment of the present invention is shown. The electrical connector 100 is mounted on a circuit board 300 in a vertical direction Z. The circuit board 300 has a plurality of solder pads 301. The electrical connector 100 is mated with a chip module 200 in the vertical direction Z. The chip module 200 is provided with a plurality of conductive sheets 201. The electrical connector 100 has an insulating body 1, and a plurality of terminals C accommodated in the insulating body 1. An upper end of each of the terminals C is electrically connected to a conductive sheet 201, and a lower end of each of the terminals C is matched with a solder material 4. The solder material 4 is attached to the solder pad 301, such that the terminal C is electrically connected to the solder pad 301, thereby facilitating the electrical connection of the electrical connector 100 to the circuit board 300 and the chip module 200.

Referring to FIG. 1, FIG. 2 and FIG. 3, the insulating body 1 defines a first direction X and a second direction Y perpendicular to each other, and the first direction X and the second direction Y are perpendicular to the vertical direction Z. The insulating body 1 has a plurality of accommodating cavities 10 to correspondingly accommodate a plurality of terminals C. The accommodating cavities 10 are arranged to form a plurality of rows of first row accommodating cavities A and a plurality of rows of second row accommodating cavities B, which are alternately arranged at intervals in the first direction X. Two adjacent rows of the first row accommodating cavities A are parallel and aligned to each other in the first direction X, and two adjacent rows of the second row accommodating cavities B are parallel and aligned to each other in the first direction X. Each row of the first row accommodating cavities A and its adjacent row of the second row accommodating cavities B are parallel and staggered to each other in the first direction X. In the second direction Y, projections of the first row accommodating cavities 10 overlap with projections of the adjacent second row accommodating cavities B.

Referring to FIG. 1, FIG. 2 and FIG. 3, each of the accommodating cavities 10 runs through upper and lower surfaces of the insulating body 1. Each of the accommodating cavities 10 has a first cavity 101 and a second cavity 102, which are interpenetrated in the first direction X and provided in a rectangular shape. A width of the first cavity 101 is greater than a width of the second cavity 102, and the first cavity 101 and the second cavity 102 both run through the upper and lower surfaces of the insulating body 1. The first cavity 101 and the second cavity 102 are used for accommodating at least a portion of the terminals C. A plurality of retaining slots 103 extend upward from the lower surface of the insulating body 1 and does not run through the upper surface of the insulating body 1. Each of the retaining slots 103 and a corresponding first cavity 101 cross each other in a "+" shape, where a height of each retaining slot 103 is approximately one third of a height of the insulating body 1. A positioning block 104 is protrudingly provided on an inner wall of the second cavity 102 and is used for positioning the corresponding terminal C in the vertical direction Z.

Referring to FIG. 1, FIG. 2 and FIG. 3, the projections of the first cavities 101 of the first row accommodating cavities A and the second cavities 102 of the adjacent second row accommodating cavities B overlap in the second direction Y and are staggeredly provided. Compared with a parallel alignment arrangement, the staggered design can form more accommodating cavities 10 on the insulating body 1 having a same size, thereby accommodating more terminals C, and enhancing the electrical performance of the electrical connector 100. The distances between each of the second cavities 102 and the first cavities 101 at its two adjacent sides thereof are equal, and the distances are substantially equal to a width of the second cavity 102, thereby ensuring the structural strength of the insulating body 1, and avoiding the insufficient strength of the insulating body 1 due to the uneven wall thickness between the accommodating cavities 10. The width of the second cavity 102 is less than a width of the first cavity 101. Compared to the case where the first cavity 101 and the second cavity 102 have the same width, the wall thickness between the first cavity 101 and the adjacent second cavity 102 is increased in this embodiment, which is advantageous for increasing the strength of the insulating body 1.

Figure 4:
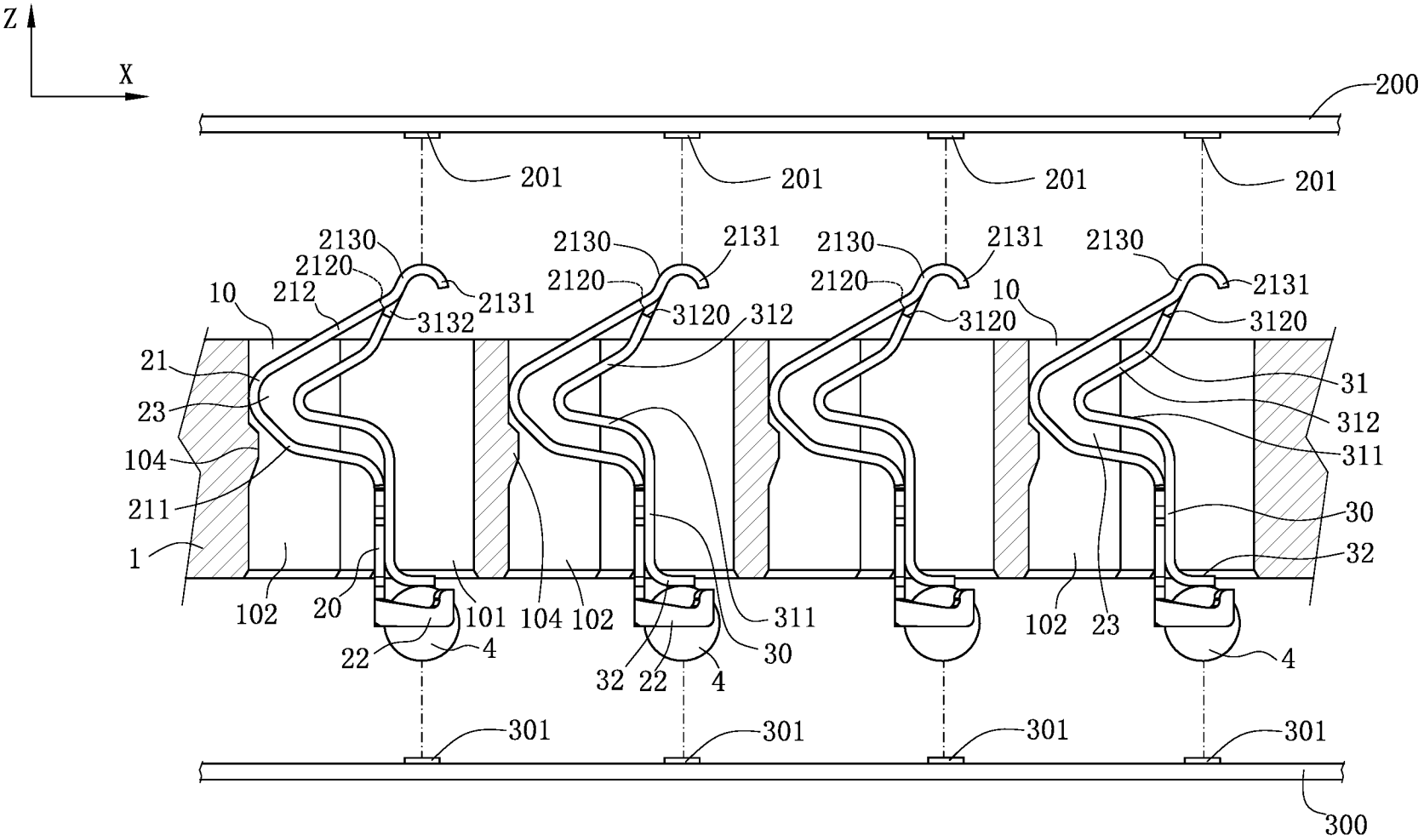
FIG. 4 is a plain exploded view of the electrical connector, the chip module and the circuit board in FIG. 3.
Figure 5A:
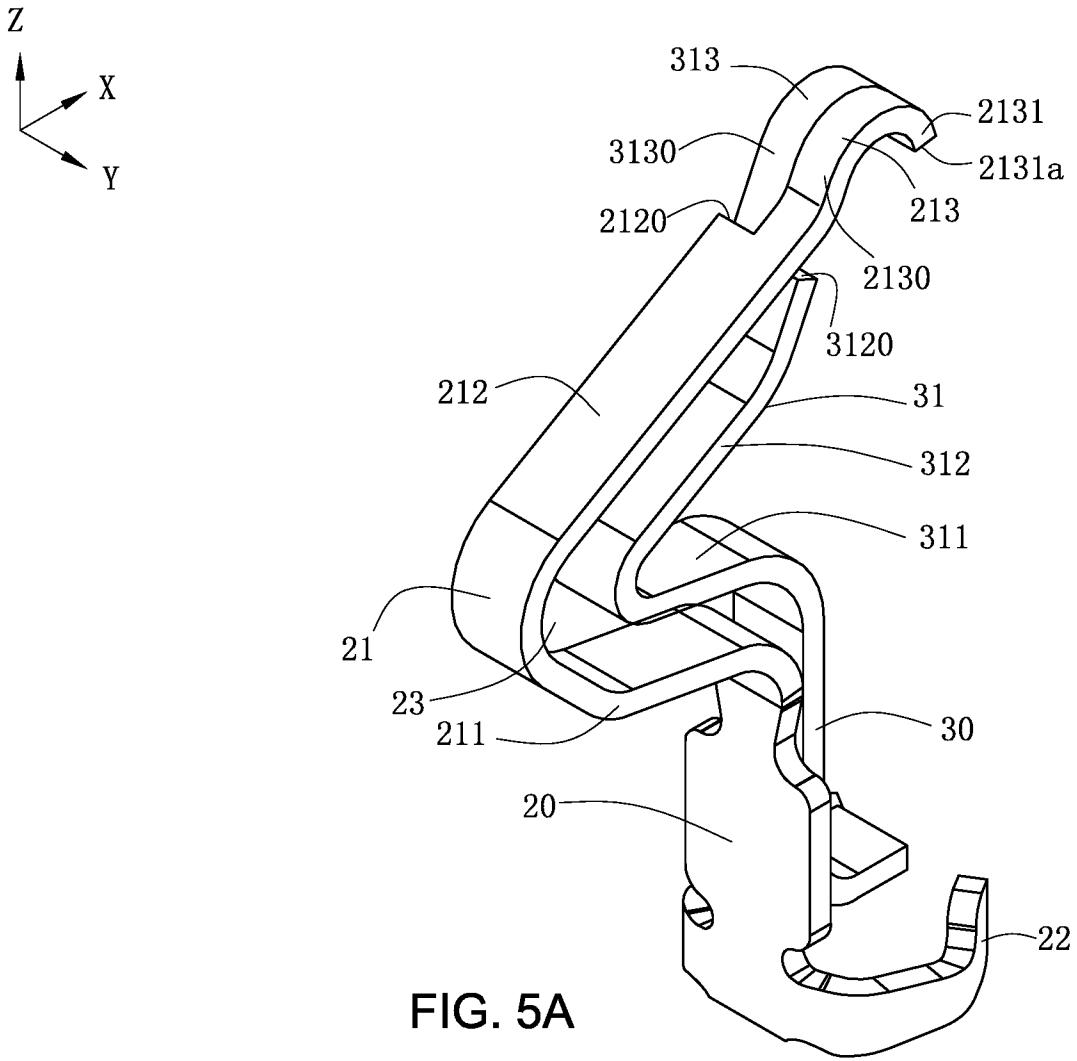
FIG. 5A is a perspective view of the terminal in FIG. 1.
Figure 5B:
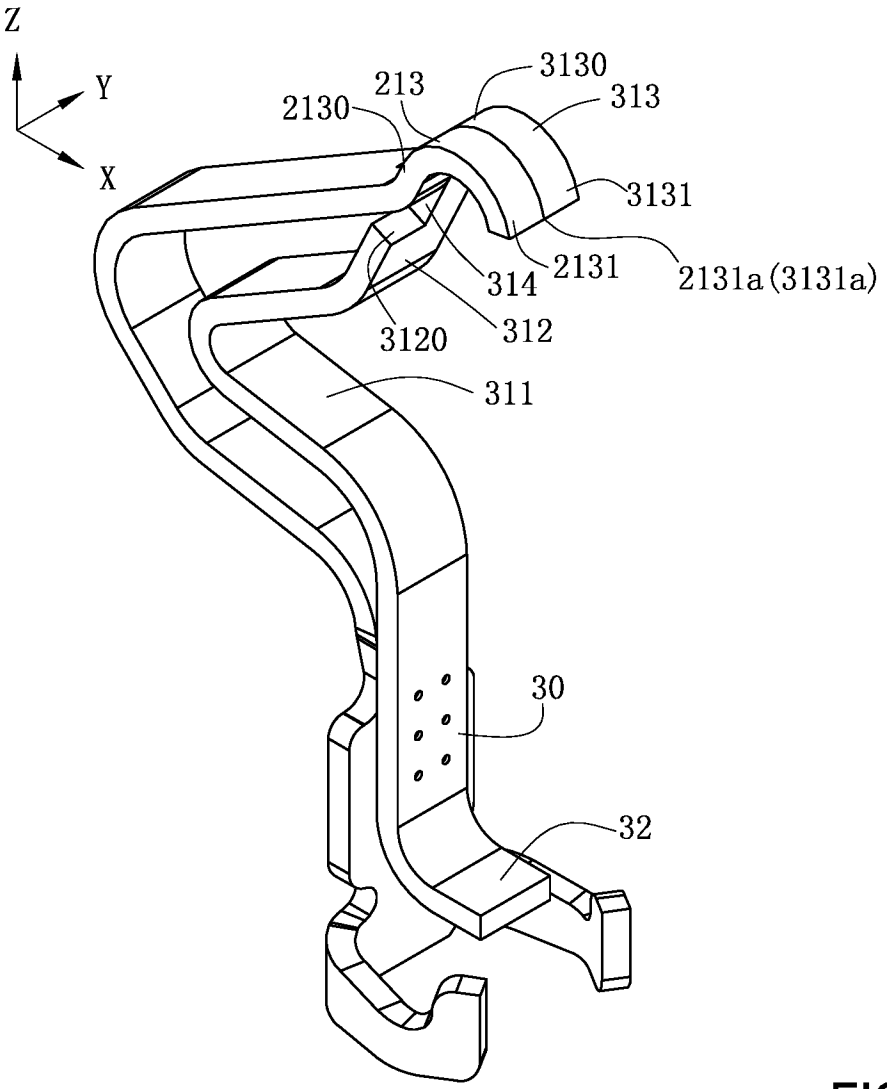
FIG. 5B is a perspective view of the terminal in FIG. 1 from a different viewing angle.

Referring to FIG. 4, FIG. 5A and FIG. 5B, each of the terminals C is formed by a first terminal 2 and a second terminal 3 independent of each other, and the first terminal 2 and the second terminal 3 are stamped from a same conductive metal sheet. The first terminal 2 and the second terminal 3 are accommodated in the same accommodating cavity 10.

Referring to FIG. 4, FIG. 5A and FIG. 5B, the first terminal 2 defines a front-rear direction X and a left-right direction Y. The first terminal 2 has a first base 20 which is in a vertical plate shape having a vertical plate surface in the vertical direction Z, and the front-rear direction X is perpendicular to the vertical plate surface of the first base 20. A first elastic arm 21 bends and extends upward from the first base 20, and a width of the first elastic arm 21 is less than a width of the first base 20, which is favorable for bending the first elastic arm 21. The first elastic arm 21 has a first portion 211, a second portion 212, a first contact portion 213 and a first notch 214. The first portion 211 extends upward and backward from the first base 20. The second portion 212 extends reversely and upward from the first portion 211. The first portion 211 and the second portion 212 form an accommodating space 23. The accommodating space 23 is in a backward concave shape and is located at a rear side of the first base 20. The first contact portion 213 extends forward from the second portion 212 and passes beyond the first base 20 in the front-rear direction. The first contact portion 213 has a first contact region 2130 extending and connected to the second portion 212, which upward abuts the conductive sheet 201 to be electrically connected to the chip module 200. The first contact portion 213 further has a first extending portion 2131, and the first extending portion 2131 extends downward and forward from the first contact region 2130. A tail end 2131*a* of the first extending portion 2131 is the tail end of the first contact portion 213. A width of the second portion 212 is greater than a width of the first contact portion 213, thereby allowing the two components to be step shaped therebetween. A first notch 214 is formed between the second portion 212 and the first contact portion 213. The first notch 214 and the first contact portion 213 are both located at the tail end of the first elastic arm 21.

Figure 6:
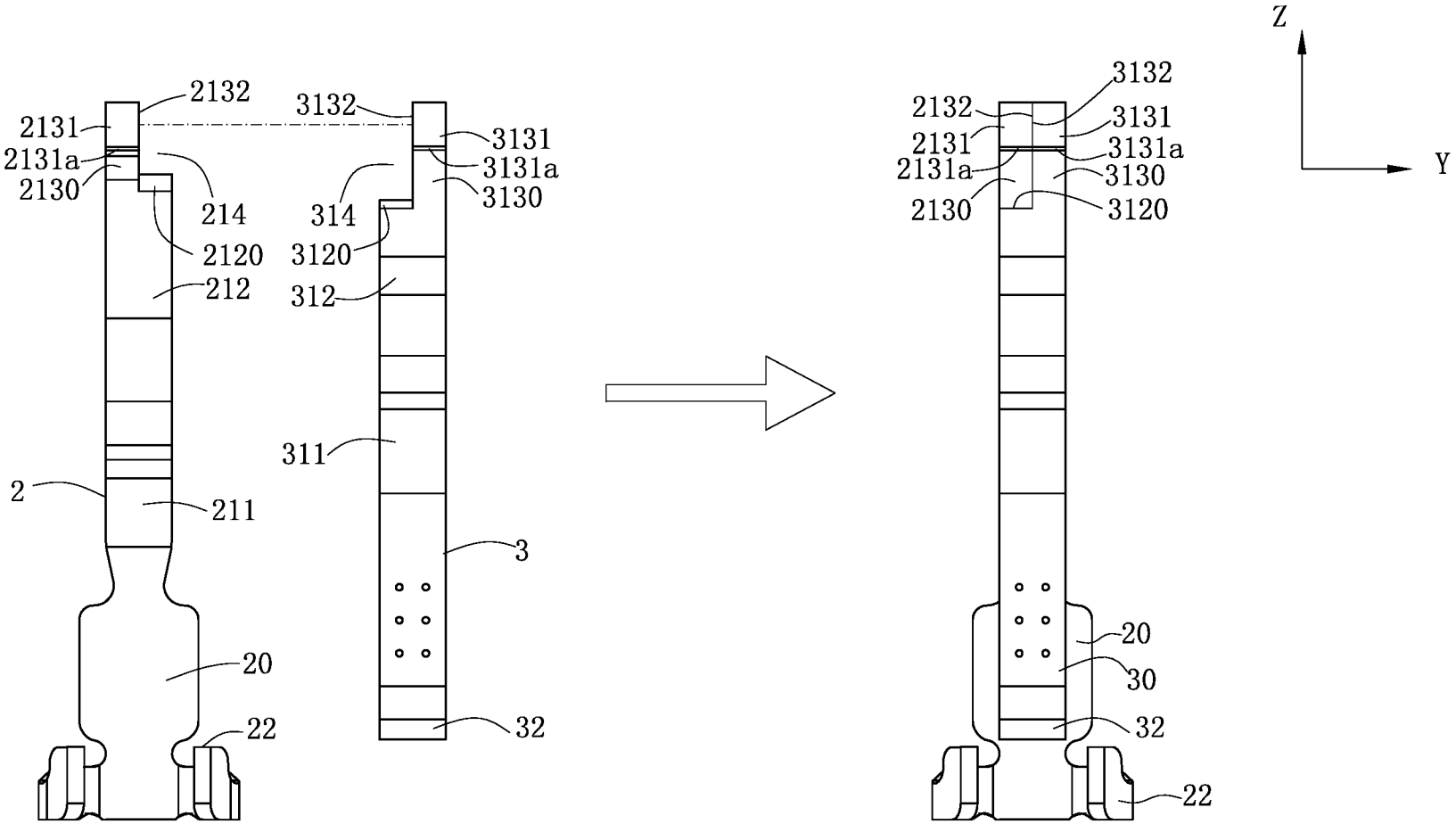
FIG. 6 is a plain view of the terminal in FIG. 1 viewing backward from the front thereof.

Referring to FIG. 6, which is a plain view of the terminal being viewed backward from the front thereof in this embodiment. In this embodiment, the first notch 214 is concavely provided on a right side surface of the tail end of the first elastic arm 21, and runs forward through the tail end of the first elastic arm 21 and does not run leftward through a left side surface of the tail end of the first elastic arm 21, thereby forming a first contact portion 213 on the first elastic arm 21. A width of the first contact portion 213 is equal to a width of the first notch 214, and the width of the first contact portion 213 and the width of the first notch 214 are equal to the width of the second portion 212. The first contact portion 213 has a first side wall 2132. The first side wall 2132 extends from the first contact region 2130 to the first extending portion 2131 and faces the first notch 214. The second portion 212 has a third side wall 2120. The third side wall 2120 is connected to the first side wall 2132 and faces the first notch 214.

Referring to FIG. 4, FIG. 5A and FIG. 5B, a first conductive portion 22 bends and extends forward from each of the left side and the right side of the lower end of the first base 20. The two first conductive portions 22 bend toward each other and are provided in a hoop. The first base 20, the first elastic arm 21 and the first conductive portions 22 form a first transmission path.

Referring to FIG. 1, FIG. 4, FIG. 5A and FIG. 5B, the second terminal 31 has a second base 30, and the second base 30 is in a vertical plate shape having a vertical plate surface in the vertical direction Z. A second elastic arm 31 bends and extends upward from the second base 30. The second elastic arm 31 has a third portion 311, a fourth portion 312, a second contact portion 313 and a second notch 314. The third portion 311 extends upward and backward from the second base 30. The fourth portion 312 extends reversely and upward from the third portion 311. The second contact portion 313 extends forward and upward from the third portion 311. The second contact portion 313 passes beyond the second base 30 in the front-rear direction. A width of the second contact portion 313 is approximately equal to one half of a width of the third portion 311. The second contact portion 313 has a second contact region 3130 extending upward from the fourth portion 312 and a second extending portion 3131 extending forward and downward from the second contact region 3130. A tail end 3131*a* of the second extending portion 3131 is the tail end of the second contact portion 313. The second contact region 3130 upward abuts the conductive sheet 201 to be electrically connected to the chip module 200. A width of the fourth portion 312 is greater than a width of the second contact portion 313, thereby allowing the two components to be step shaped therebetween. A second notch 314 is formed between the fourth portion 312 and the second contact portion 313. The second notch 314 and the second contact portion 313 are both located at the tail end of the second elastic arm 31.

Referring to FIG. 4, FIG. 5A, FIG. 5B and FIG. 6, in this embodiment, the second notch 314 is concavely provided on a left side surface of the tail end of the second elastic arm 31, and the second notch 314 runs forward through the tail end of the second elastic arm 31 and does not run rightward through the right side surface of the second elastic arm 31, thereby forming the second contact portion 313. The second contact portion 313 has a second side wall 3132, and the second side wall 3132 extends from the second contact region 3130 to the second end 3131 and faces the second notch 314. The fourth portion 312 has a fourth side wall 3120, and the fourth side wall 3120 is connected to the second side wall 3132 and faces the second notch 314.

A second conductive portion 32 bends and extends downward and forward from the lower end of the second base 30, and the second conductive portion 32 is attached to the solder material 4 to be electrically connected to the solder pad 301. The second elastic arm 31, the second base 30 and the second conductive portion 32 form a second transmission path. An electrical signal is transmitted to the solder pad 301 through the second transmission path.

Referring to FIG. 4, FIG. 5A, FIG. 5B and FIG. 6, the second base 30 is attached, soldered and fixed to a front plate surface of the first base 20. The remaining portions of the second elastic arm 31, except the second contact portion 313, are located below the first contact portion 213. The third portion 311 and the fourth portion 312 are accommodated in the accommodating space 23. The first contact portion 213 enters the second notch 314 forward from the rear thereof. The second contact portion 313 enters the first notch 214 upward from the bottom thereof. The first extending portion 2131 is accommodated in the second notch 314 and flush with the second extending portion 3131 at the front, and the first contact region 2130 is accommodated in the second notch 314 and flush with the second contact region 3130 in the vertical direction. Compared with the related art, the size of the first elastic arm 21 and the second elastic arm 31 in the front-rear direction is reduced, thereby allowing more terminals C to be provided in a limited space above the insulating body 1. The first side wall 2132 and the second side wall 3132 abut each other, such that the first transmission path and the second transmission path can electrically connect each other, which is favorable for transmitting high-frequency signals, and the first contact portion 213 and the second contact portion 313 are closely attached with each other in the left-right direction. A sum of the widths of the first contact portion 213 and the second contact portion 313 is approximately equal to the width of the first elastic arm 21, thereby reducing the size of the terminal in the front-rear direction and avoiding increasing the size of the terminal in the left-right direction, which is favorable for the miniaturization of the terminal.

Referring to FIG. 4, FIG. 5A, FIG. 5B and FIG. 6, the tail end 2131*a* of the first extending portion 2131 and the tail end 3131*a* of the second extending portion 3131 abut each other. In the related art, the first contact portion and the second contact portion are spaced apart, a portion of the electrical signals are transmitted to the tail end of the first contact portion and the tail end of the second contact portion, and this portion of the electrical signals are not returned to the circuit board through the transmission channel, resulting in the loss of this portion of the electrical signals. In this case, the tail end of the first contact portion and the tail end of the second contact portion are equivalent to two invalid transmission paths of electrical signals. Compared with the related art, the tail end 2131*a* of the first extending portion 2131 and the tail end 3131*a* of the second extending portion 3131 in this embodiment abut each other, such that the first extending portion 2131 and the second extending portion 3131 only form one invalid conductive path of electrical signals, thereby reducing the transmission loss of the electrical signals and facilitating the transmission of high-frequency signals. Further, the first side wall 2132 of the first extending portion 2131 and the second side wall 3132 of the second extending portion 3131 are also attached to each other, increasing the contact area of the first terminal 2 and the second terminal 3, thus facilitating the temperature resistance of the terminals C. Moreover, assuming that the first side wall 2132 and the second side wall 3132 are provided separately, the invalid conductive path of electrical signals is a sum of the length of the first extending portion 2131 and the length of the second extending portion 3131. Compared with the assumption, the first side wall 2132 of the first extending portion 2131 and the second side wall 3132 of the second extending portion 3131 in this embodiment are attached to each other, thereby shortening the invalid conductive path of the terminal C, thus reducing the transmission loss of the electrical signals and facilitating the transmission of high-frequency signals.

Referring to FIG. 4, FIG. 5A, FIG. 5B and FIG. 6, the third side wall 2120 downward stops the second contact portion 313 to prevent the second contact portion 313 from moving upward, which is advantageous for maintaining the contact between the first side wall 2132 and the second side wall 3132. The fourth side wall 3120 upward stops the first contact portion 213. When the chip module 200 downward abuts the first contact portion 213, the fourth side wall 3120 supports the first contact portion 213, thus increasing the strength of the terminal, which is advantageous for protecting the elastic performance of the first elastic arm 21.

Referring to FIG. 4, FIG. 5A, FIG. 5B and FIG. 6, the second conductive portion 32 is located above the first conductive portion 22, and the lower end of the first base 20, the first conductive portion 22 and the second conductive portion 32 jointly clamp the same solder material 4. The lower end of the first base 20 is located behind the solder material 4, and the two first conductive portions 22 clamp the left and right sides of the solder material 4. The second conductive portion 32 is attached above the solder material 4, and the first terminal 2 and the second terminal 31 are both attached to the solder material 4, thus increasing the contact area between the solder material 4 and the terminal, which is favorable for the soldering and fixing of the terminal.

Referring to FIG. 4, FIG. 5A, FIG. 5B and FIG. 6, the terminal C formed by the first terminal 2 and the second terminal 31 is mounted in the accommodating cavity 10. The first base 20 is fixed in the retaining slot 103 and the first cavity 101, the second base 30 is accommodated in the first cavity 101, the first elastic arm 21 and the second elastic arm 31 are respectively accommodated in the first cavity 101 and the second cavity 102, the first elastic arm 21 extends from the second cavity 102 out of the upper surface of the insulating body 1, and the second elastic arm 31 extends from the first cavity 101 out of the upper surface of the insulating body 1. The first contact portion 213 and the second contact portion 313 are both exposed from the upper surface of the insulating body 1 for upward abutting the chip module 200. The first conductive portion 22 and the second conductive portion 32 are exposed from the lower surface of the insulating body 1 to facilitate the soldering and mounting of the electrical connector 100 to the circuit board 300.

Figure 7:
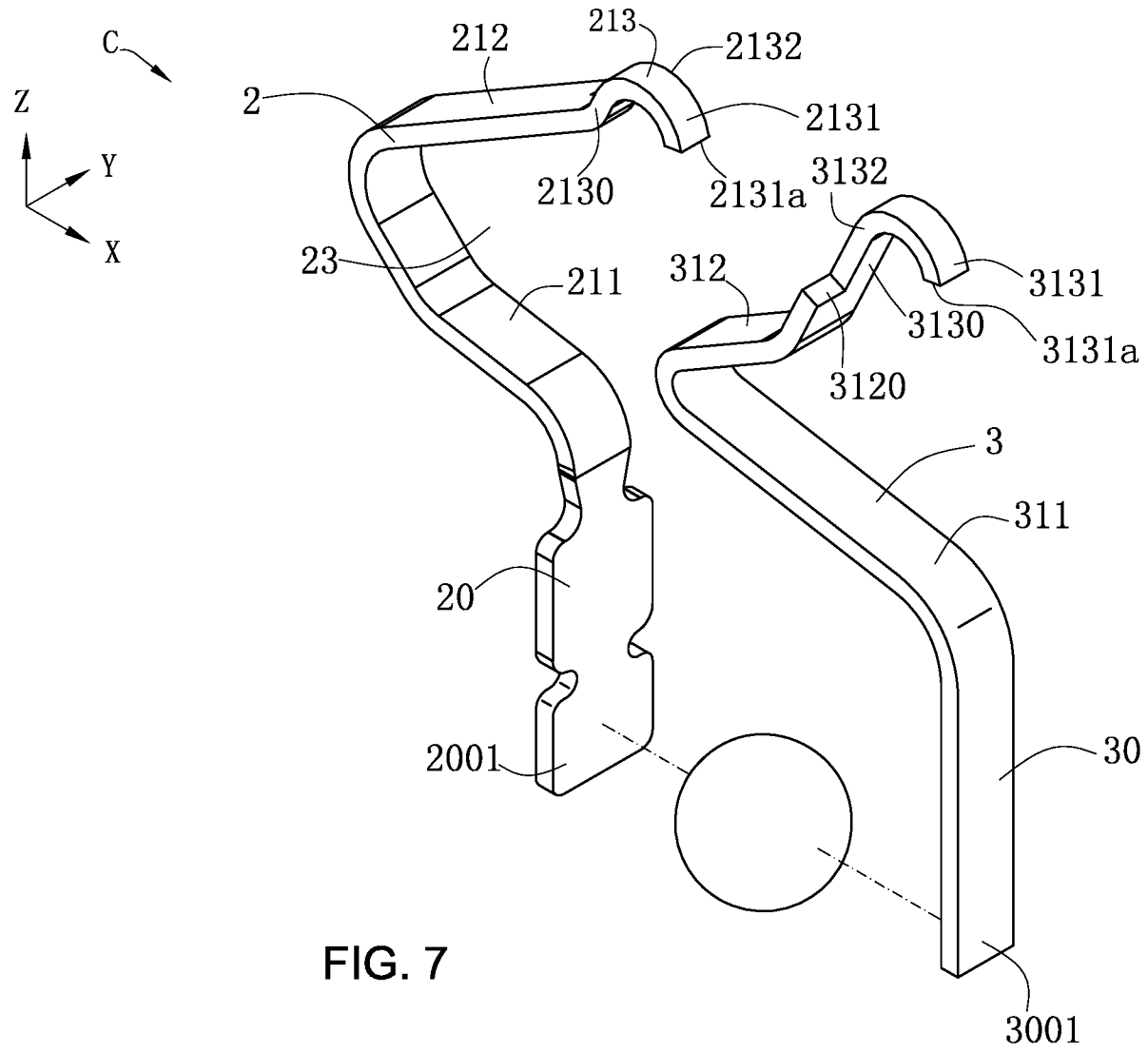
FIG. 7 is a perspective exploded view of a terminal according to a second embodiment of the present invention.
Figure 8:
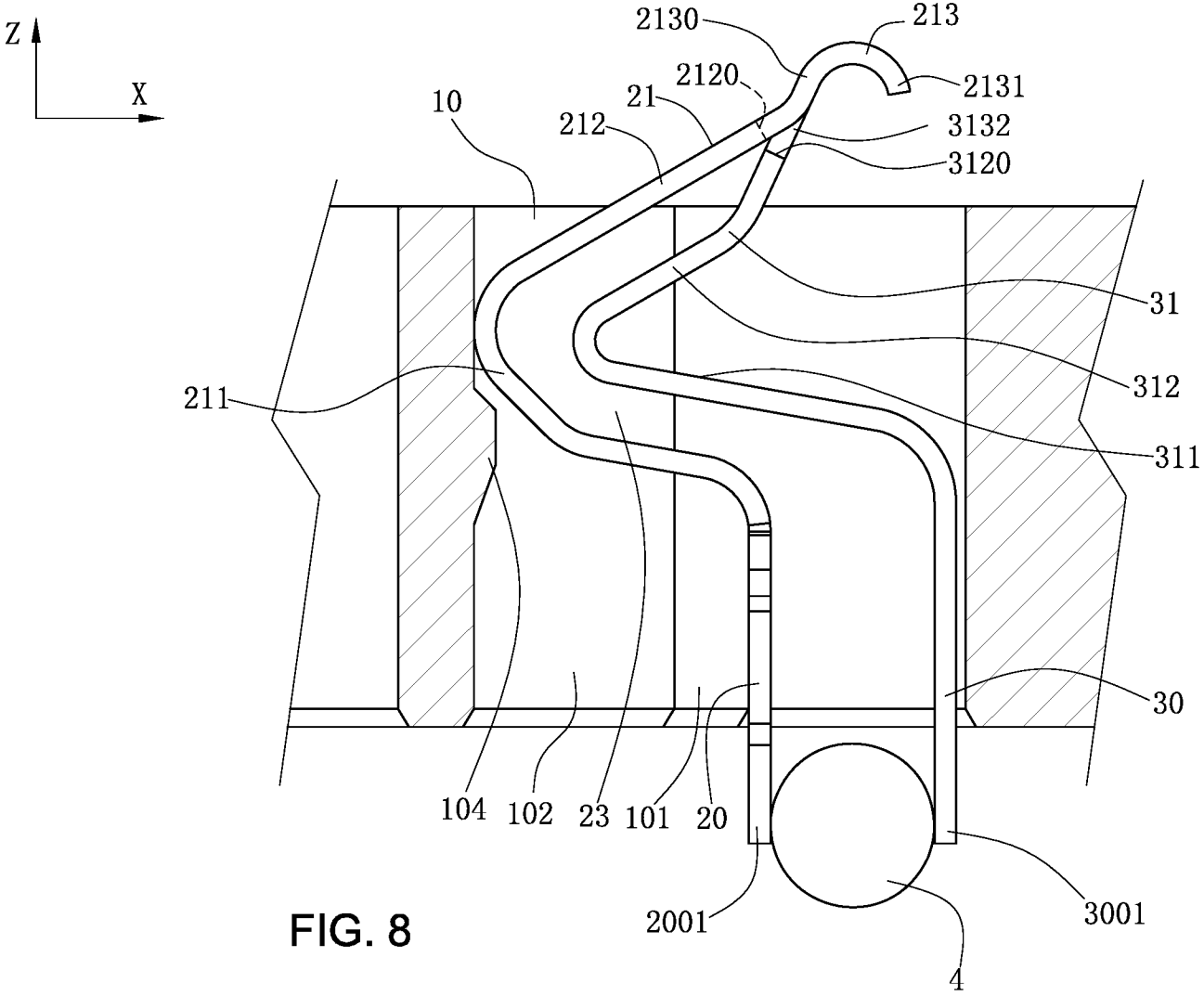
FIG. 8 is a plain view of the terminal in FIG. 7 after being assembled.

Referring to FIG. 7 and FIG. 8, a perspective view of a terminal C according to a second embodiment of the present invention is shown. The terminal C according to the second embodiment is different from the terminal C according to the first embodiment in that: the lower end of the first base 20 vertically provided is a first conductive portion 2001, and the lower end of the second base 30 vertically provided is a second conductive portion 3001. The first base 20 and the second base 30 are spaced apart in the front-rear direction X such that the first conductive portion 2001 and the second conductive portion 3001 are spaced apart in the front-rear direction X. A solder material 4 is accommodated between the first conductive portion 2001 and the second conductive portion 3001, and the second conductive portion 3001 and the first conductive portion 2001 respectively abut the solder material 4 in the front-rear direction X.

To sum up, the electrical connector according to certain embodiments of the present invention have the following beneficial effects:

1. The remaining portions of the second elastic arm 31, except the second contact portion 313, are located below the first contact portion 213. The third portion 311 and the fourth portion 312 are accommodated in the accommodating space 23. The first contact portion 213 enters the second notch 314 forward from the rear thereof. The second contact portion 313 enters the first notch 214 upward from the bottom thereof. The first extending portion 2131 is accommodated in the second notch 314 and flush with the second extending portion 3131 at the front, and the first contact region 2130 is accommodated in the second notch 314 and flush with the second contact region 3130 in the vertical direction. Compared with the related art, the size of the first elastic arm 21 and the second elastic arm 31 in the front-rear direction is reduced, thereby allowing more terminals C to be provided in a limited space above the insulating body 1.

2. The first side wall 2132 and the second side wall 3132 abut each other, such that the first transmission path S1 and the second transmission path S2 can electrically connect each other, which is favorable for transmitting high-frequency signals, and the first contact portion 213 and the second contact portion 313 are closely attached with each other in the left-right direction. A sum of the widths of the first contact portion 213 and the second contact portion 313 is approximately equal to the width of the first elastic arm 21, thereby reducing the size of the terminal in the front-rear direction and avoiding increasing the size of the terminal in the left-right direction, which is favorable for the miniaturization of the terminal.

3. The tail end 2131*a* of the first extending portion 2131 and the tail end 3131*a* of the second extending portion 3131 also abut each other. In the related art, the first contact portion and the second contact portion are spaced apart, a portion of the electrical signals are transmitted to the tail end of the first contact portion and the tail end of the second contact portion, and this portion of the electrical signals are not returned to the circuit board through the transmission channel, resulting in the loss of this portion of the electrical signals. In this case, the tail end of the first contact portion and the tail end of the second contact portion are equivalent to two invalid transmission paths of electrical signals. Compared with the related art, the tail end 2131*a* of the first extending portion 2131 and the tail end 3131*a* of the second extending portion 3131 in this embodiment abut each other, such that the first extending portion 2131 and the second extending portion 3131 only form one invalid conductive path of electrical signals, thereby reducing the transmission loss of the electrical signals and facilitating the transmission of high-frequency signals.

4. The third side wall 2120 downward stops the second contact portion 313 to prevent the second contact portion 313 from moving upward, which is advantageous for maintaining the contact between the first side wall 2132 and the second side wall 3132.

5. The fourth side wall 3120 upward stops the first contact portion 213. When the chip module 200 downward abuts the first contact portion 213, the fourth side wall 3120 supports the first contact portion 213, thus increasing the strength of the terminal, which is advantageous for protecting the elastic performance of the first elastic arm 21.

6. The lower end of the first base 20 is located behind the solder material 4, and the two first conductive portions 22 clamp the left and right sides of the solder material 4. The second conductive portion 32 is attached above the solder material 4, and the first terminal 2 and the second terminal 31 are both attached to the solder material 4, thus increasing the contact area between the solder material 4 and the terminal, which is favorable for the soldering and fixing of the terminal C.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured to electrically connect a circuit board and an electronic component, the electronic component having at least one conductive member configured to be electrically connected to the electrical connector, and the electrical connector comprising:

an insulating body;

at least one first terminal having a first base accommodated in the insulating body, and a first elastic arm extending upward from the first base and exposed from the insulating body, wherein the first elastic arm has a first contact portion and a first notch; and at least one second terminal having a second base fixed to the first base, and a second elastic arm extending upward from the second base and exposed from the insulating body, wherein the second elastic arm has a second contact portion;

wherein the first contact portion and the second contact portion both extend forward, and the second contact portion is accommodated in the first notch such that the first contact portion and the second contact portion are in contact with a same one of the at least one conductive member.

2. The electrical connector according to claim 1, wherein the first contact portion and the second contact portion are provided face-to-face in a left-right direction.

3. The electrical connector according to claim 2, wherein the first contact portion has a first side wall facing the second contact portion, the second contact portion has a second side wall facing the first contact portion, and the first side wall and the second side wall are provided to be attached in the left-right direction.

4. The electrical connector according to claim 3, wherein a tail end of the first contact portion is in contact with a tail end of the second contact portion.

5. The electrical connector according to claim 1, wherein the first elastic arm has a first portion and a second portion, the first portion extends upward and backward from the first base, the second portion extends reversely and upward from the first portion, the first contact portion extends upward and forward from the second portion, and a width of the first contact portion is less than a width of the second portion to form the first notch.

6. The electrical connector according to claim 5, wherein the second elastic arm has a third portion and a fourth portion, the third portion extends upward and backward from the second base, the fourth portion extends reversely and upward from the third portion, the second contact portion extends upward and forward from the fourth portion, and a width of the second contact portion is less than a width of the fourth portion to form a second notch.

7. The electrical connector according to claim 6, wherein the first contact portion is located at the second notch, and the second contact portion is located at the first notch.

8. The electrical connector according to claim 6, wherein the first portion and the second portion form an accommodating space, the third portion and the fourth portion are both accommodated in the accommodating space, the first portion and the third portion are provided face-to-face to each other, and the second portion and the fourth portion are provided face-to-face to each other.

9. The electrical connector according to claim 8, wherein the second portion has a third side wall connected to the first contact portion and facing the first notch, and the third side wall downward stops the second contact portion.

10. The electrical connector according to claim 9, wherein the fourth portion has a fourth side wall connected to the second contact portion and facing the second notch, and the fourth side wall upward stops the first contact portion.

11. The electrical connector according to claim 1, wherein a sum of a width of the first contact portion and a width of the second contact portion is less than or equal to a width of the first elastic arm.

12. The electrical connector according to claim 1, further comprising:

a first conductive portion configured to be electrically connected to the circuit board, wherein the first conductive portion is electrically connected to a lower end of the first base;

a second conductive portion configured to be electrically connected to the circuit board, wherein the second conductive portion is electrically connected to a lower end of the second base and located above the first conductive portion; and a solder material, wherein the first conductive portion and the second conductive portion are attached to the same solder material, and the solder material solders and fixes the first conductive portion and the second conductive portion to the circuit board.

13. An electrical connector configured to electrically connect a circuit board and an electronic component, the electronic component having at least one conductive member configured to be electrically connected to the electrical connector, and the electrical connector comprising:

an insulating body;

at least one first terminal accommodated in the insulating body, wherein an upper end of the first terminal has a first contact portion and a first notch, and a lower end of the first terminal has a first conductive portion;

at least one second terminal, wherein an upper end of the second terminal has a second contact portion, and a lower end of the second terminal has a second conductive portion; and a solder material configured to electrically connect the first conductive portion and the second conductive portion to the circuit board, wherein the first conductive portion and the second conductive portion are attached to the same solder material;

wherein the first contact portion and the second contact portion both extend forward, and the second contact portion is accommodated in the first notch such that the first contact portion and the second contact portion are in contact with a same one of the at least one conductive member.

14. The electrical connector according to claim 13, wherein the first contact portion and the second contact portion are provided face-to-face in a left-right direction.

15. The electrical connector according to claim 14, wherein the first contact portion has a first side wall facing the second contact portion, the second contact portion has a second side wall facing the first contact portion, and the first side wall and the second side wall are provided to be attached in the left-right direction.

16. The electrical connector according to claim 15, wherein a tail end of the first contact portion is in contact with a tail end of the second contact portion.

17. The electrical connector according to claim 13, wherein the first terminal further has a first base connected to the first conductive portion, a first portion extends upward and backward from an upper end of the first base, a second portion extends reversely and upward from the first portion, the first contact portion extends upward from the second portion, and the first portion and the second portion form an accommodating space configured to accommodate a portion of the second terminal.

18. The electrical connector according to claim 17, wherein the second terminal further has a second base connected to the second conductive portion, a third portion extends upward from the upper end of the second base, a fourth portion extends reversely and upward from the third portion, the second contact portion extends upward from the fourth portion, and the third portion and the fourth portion are accommodated in the accommodating space.

19. The electrical connector according to claim 13, wherein the first terminal further has a first base, a lower end of the first base is connected to the first conductive portion, the second terminal further has a second base, a lower end of the second base is connected to the second conductive portion, the first base and the second base are spaced apart, the first conductive portion and the second conductive portion are spaced apart, and the solder material is located between the first conductive portion and the second conductive portion.

20. The electrical connector according to claim 13, wherein the first terminal further has a first base, two first conductive portions respectively extend from a left side and a right side of the first base, the second terminal further has a second base attached and fixed to the first base, the second conductive portion extends forward from a lower end of the second base, the two first conductive portions are respectively located at a left side and a right side of the solder material, and the second conductive portion is located above the solder material.

* * * * *